United States Patent [19]

Cunningham

[11] 4,052,639

[45] Oct. 4, 1977

[54] SPARK GAP FOR ACHIEVING ARC ELONGATION AND COMPRESSION WITHOUT THE USE OF SUPPLEMENTARY MAGNETIC MEANS

[75] Inventor: Francis V. Cunningham, Western Springs, Ill.

[73] Assignee: Joslyn Mfg. and Supply Co., Chicago, Ill.

[21] Appl. No.: 648,758

[22] Filed: Jan. 13, 1976

[51] Int. Cl.[2] ..... H01J 17/00; H01J 21/00

[52] U.S. Cl. ..... 313/325; 313/231.1; 315/35; 315/36; 361/137

[58] Field of Search ..... 317/69; 313/325, 326, 313/231.1; 315/35, 36; 361/117, 137

[56] References Cited

U.S. PATENT DOCUMENTS

| | | | |
|---|---|---|---|
| 2,917,662 | 12/1959 | Cunningham | 315/36 |
| 3,152,279 | 10/1964 | Misare | 315/36 X |
| 3,263,117 | 7/1966 | Nilsson | 315/36 |
| 3,484,863 | 12/1969 | Kershaw, Jr. | 315/36 X |
| 3,504,221 | 3/1970 | Osterhout | 313/325 |
| 3,518,483 | 6/1970 | Eason et al. | 315/36 |
| 3,576,459 | 4/1971 | Sakshaug et al. | 315/36 |

*Primary Examiner*—Saxfield Chatmon, Jr.
*Attorney, Agent, or Firm*—Mason, Kolehmainen, Rathburn & Wyss

[57] ABSTRACT

A current limiting spark gap for use in a valve type lightning or surge arrester includes a plurality of identical, mirror-image insulating gap plates assembled together to define arc elongation and cooling chambers between each pair of adjacent gap plates. Conductive electrodes are disposed on opposite sides of each gap plate. Dielectric rods extend through holes formed in the gap plates to vertically and horizontally align the gap plates in a vertical stack and to define and maintain the gap spacing between a pair of electrodes in each arc chamber. The spark gap utilizes only the electrode and arc chamber configurations to cause a follow current arc to move in each arc chamber to increase the length of the arc and to compress the arc against cooling walls and surfaces of the arc chambers. The electrode and arc chamber configurations achieve greater arc elongation and compression, and resultant cooling, to enhance follow current limitation. The follow current arc is elongated and compressed from a point of arc initiation through a projected angle exceeding 200°.

11 Claims, 7 Drawing Figures

Fig. 4
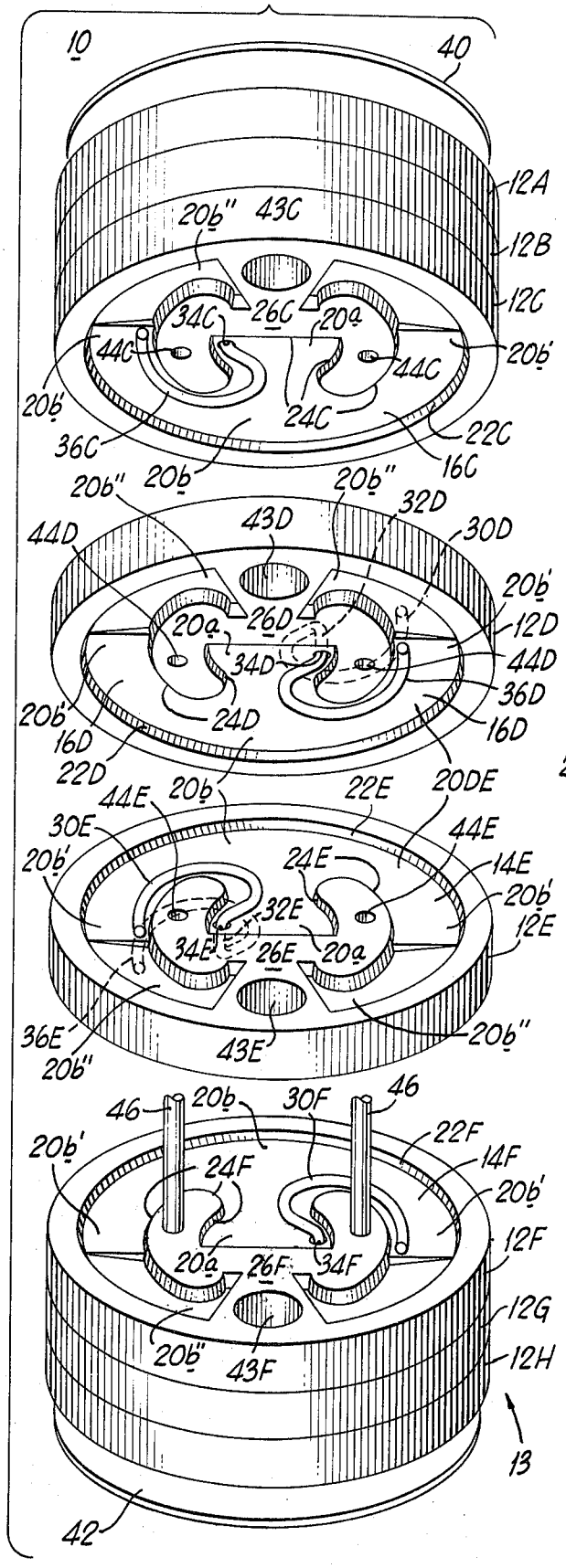
Fig. 5
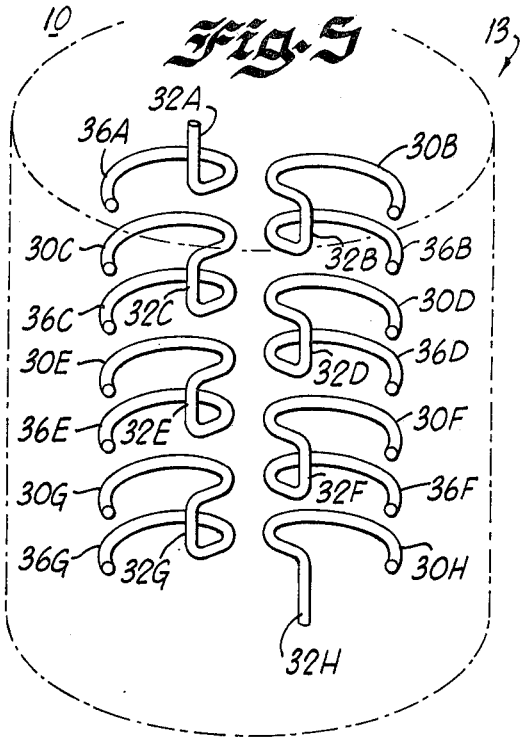
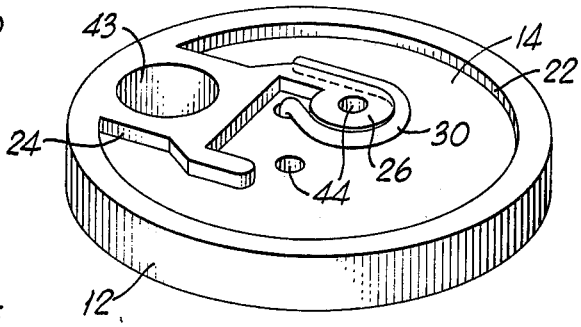
Fig. 6
Fig. 7
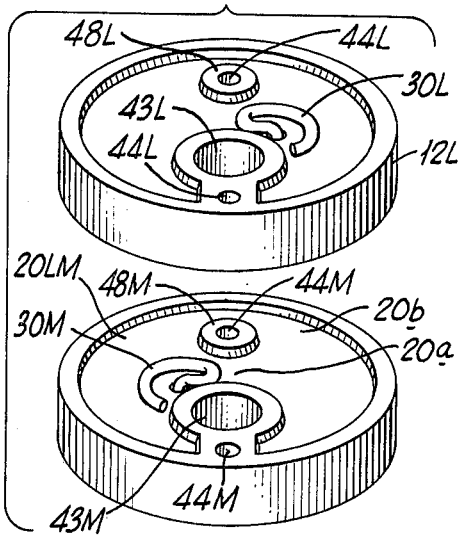

SPARK GAP FOR ACHIEVING ARC ELONGATION AND COMPRESSION WITHOUT THE USE OF SUPPLEMENTARY MAGNETIC MEANS

BACKGROUND OF THE INVENTION

A. Field of the Invention

The device of the present invention generally relates to a spark gap for a surge arrester and, more particularly, to a current limiting spark gap for a valve type surge arrester.

B. Description of the Prior Art

Valve type surge arresters having a spark gap electrically connected in series with one or more blocks of non-linear resistance valve material and electrically connected between an electrical power line conductor and ground are well known in the prior art. Many prior art spark gaps utilize magnetic means, such as permanent magnets or electrical coils for elongating electrical arcs to develop high arc voltages and thus facilitate the interruption of power follow current.

Other prior art spark gaps utilize merely the conductive electrode and arc chamber configurations to elongate power follow arcs and omit supplementary magnetic means, such as the above-mentioned permanent magnets and electrical coils. Examples of the latter type of spark gaps are illustrated in U.S. Pat. Nos. 2,917,662; 3,242,376; 3,259,780; and 3,504,226. Generally, the spark gaps illustrated in the above-identified patents suffer from one or more deficiencies. For example, a common deficiency is the unnecessarily complex and expensive configuration of the spark gap. In addition, many of the spark gaps do not develop sufficiently high arc voltages to significantly enhance power follow current limitation.

SUMMARY OF THE INVENTION

An object of the present invention is to provide a new and improved spark gap.

Another object of the present invention is to provide a new and improved current limiting spark gap for a valve type surge arrester.

Another object of the present invention is to provide a new and improved gap plate for use in a spark gap.

Another object of the present invention is to provide a new and improved wire electrode configuration and method of forming a wire electrode on a gap plate in a spark gap.

Another object of the present invention is to provide a new and improved method and means for indexing a plurality of insulating gap plates assembled together in a stacked condition to form a spark gap.

Another object of the present invention is to provide a new and improved method and means for defining and maintaining the gap spacing between a pair of electrodes in spark gap.

Briefly, a new and improved spark gap for a valve type surge arrester is disclosed herein and includes a plurality of identical, mirror-image insulating gap plates assembled together in a vertical stack to define an arc elongation and cooling chamber between each pair of adjacent gap plates. Wall portions and surfaces are formed on each gap plate side to define one-half of an arc chamber. Conductive electrodes are disposed on opposite sides of each of the gap plates and, in one embodiment, are integral portions of a single wire that passes through a hole in the gap plate.

A pair of elongated, unitary, dielectric rods extend through holes formed in each of the gap plates to vertically and horizontally align the gap plates in a vertical stack and to define and maintain the gap spacing between each pair of electrodes in each arc chamber.

The electrodes and the arc chambers are configured to achieve the elongation and cooling of power follow current arcs without the provision of supplementary magnetic devices, such as permanent magnets or electrical coils. The electrode and arc chamber configurations achieve grater arc elongation and compression, and thus higher arc voltages to enhance follow current limitation, than may be achieved with prior art configurations. The follow current arc is elongated and compressed from a point of arc initiation through a projected angle exceeding 200°.

BRIEF DESCRIPTION OF THE DRAWINGS

The above and other objects and advantages and novel features of the present invention will become apparent from the following detailed description of the preferred embodiment of the present invention illustrated in the accompanying drawing wherein:

FIG. 4 is an enlarged, exploded, perspective view of the spark gap of FIG. 1;

FIG. 5 is an enlarged, fragmentary, perspective view of the electrode configuration of the spark gap of FIG. 1;

FIG. 6 is an enlarged, perspective view of an alternate embodiment of gap plate configuration and a wire electrode configuration constructed in accordance with the principles of the present invention; and FIG. 7 is an enlarged, perspective view of an alternate embodiment of a gap plate configuration constructed in accordance with the principles of the present invention.

DESCRIPTION OF THE PREFERRED EMBODIMENT

In accordance with an important feature of the present invention, a new and improved spark gap 10 (FIGS. 1-5) achieves electrical arc elongation and compression by means of spark gap, electrode and arc chamber configurations alone, without supplementary magnetic means such as the permanent magnets or electrical coils. The spark gap 10 includes a plurality of porous, identical, mirror-image, insulating gap plates 12. In the specific embodiment disclosed, eight gap plates 12A through 12H are assembled together in a vertical stack 13 to form seven arc chambers within the stack 13.

Porous insulating gap plates are well known in the prior art and may be manufactured by any one of many different formulations of porous materials. For example, porous alumina may be used to form the gap plates 12. For a more specific discussion of porous, insulating gap plates, reference may be had to U.S. Pat. Nos. 3,151,273 and 3,443,149 and to the patents referred to therein.

Figure 2:
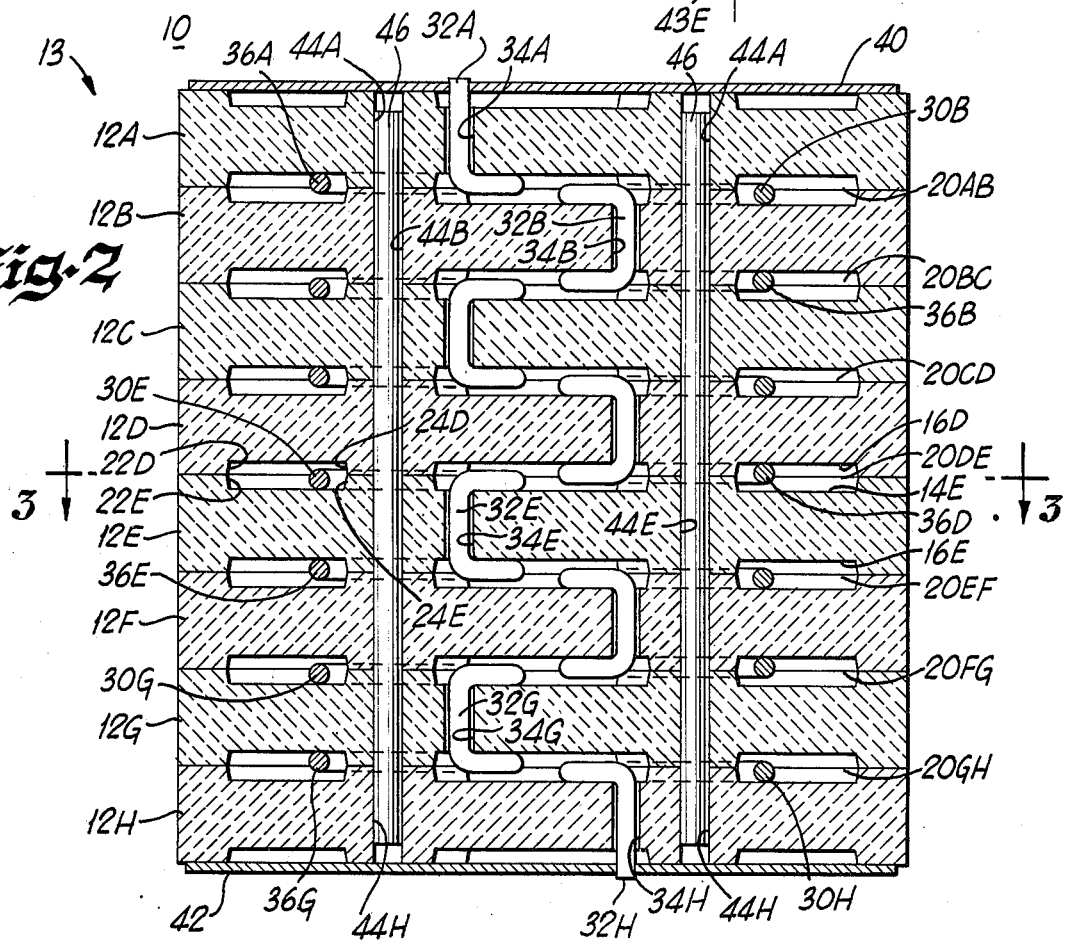
FIG. 2 is an enlarged, cross-sectional view of the spark gap of FIG. 1 taken along line 2—2 of FIG. 1.

In accordance with an important feature of the present invention, greater arc elongation within a given arrester housing is achieved along with provision of an aperture 43E (FIG. 3) for a voltage grading resistor (not illustrated) by configuring the gap plates 12 and the electrodes disposed thereon to provide arc chambers and electrodes having the same horizontal orientation throughout the vertical stack 13 (FIGS. 2, 4 and 5). This is achieved, in a specific embodiment, by configuring the major physical features of a generally horizontally extending upper surface 14E of the gap plate 12E (FIG. 3) to overlie similar physical features on an oppositely disposed, generally horizontally extending lower surface 16E of the gap plate 12E. Similarly, a conductive electrode 30E is disposed on the surface 14E to overlie a conductive electrode 36E disposed on the surface 16E. Thus, while all of the gap plates 12 in the stack 13 (FIG. 2) are physically identical, adjacent facing gap plates 12 are assembled in the stack 13 in a reversed condition as illustrated in FIG. 2 to define arc elongation and cooling chambers 20 between adjacent facing gap plates 12 and to enable the vertical alignment of the apertures 43A through 43H.

Exemplary arc chamber 20DE is defined by a plurality of peripherally extending walls 22D and 22E of adjacent, facing gap plates 12D and 12E, by a plurality of interior walls 24D and 24E of adjacent, facing gap plates 12D and 12E, by the surface 16D of the gap plate 12D and by the surface 14E of the gap plate 12E. The walls 24E also define upraised, pedestal portions or bosses 26E. The bosses 26D and 26E may be used to divide the chamber 20DE into different sections and to retard the flow of gases between the different sections. In addition, as illustrated in the alternate embodiment of FIG. 6, the pedestal portions 26 may be used to define electrode configurations, as discussed more fully hereinafter. In the specific embodiment of FIGS. 2–5, the chamber 20DE includes an innermost section **20*a* and an arc elongation and cooling section 20*b* formed by a relatively shallow chamber section 20*b*′ for initially receiving and cooling an electrical arc and remote, relatively deep chamber sections 20*b*″ separated from the innermost section 20*a* by the bosses 26D and 26E. The remote sections 20*b*″** may be formed with a non-uniform or tapered depth.

In accordance with a further important feature of the present invention, the conductive electrode 30E disposed on the upper surface 14E of the plate 12E is serially electrically connected by an elongated, axially extending, conductive portion 32E extending through an elongated, axially extending aperture 34E in the gap plate 12E with a conductive electrode 36E disposed on the opposite, lower surface 16E of the gap plate 12E. Preferably, the electrode 30E, the conductive portion 32E, and the electrode 36E are all integral portions of the same piece of metallic wire, for example, a copper wire 0.081 inches in diameter. The electrodes 30E and 36E may be formed by passing a unitary wire through the aperture 34A and bending the elongated portions of the wire on both sides of the aperture 34E at the surfaces 14E and 16E to form the electrodes 30E and 36E, respectively. Subsequently, the electrodes 30E and 36E may be mechanically pressed against the surfaces 14E and 16E to securely retain the electrodes 30E and 36E at their proper locations on the surfaces 14E and 16E.

The integrally formed wire electrodes 30E and 36E replace the rivets, welds and conductive cements typically used in the prior art to interconnect the lock preformed electrodes into place. Such prior art techniques often resulted in expensive, but uncertain joints between electrodes formed on opposite surfaces of insulating gap plates. In addition, the wire electrodes 30E and 36E, as opposed to the flat plate electrodes commonly found in the prior art, concentrate to a greater extend the magnetic flux at the arc terminals on the electrodes 30 and 36 to thereby more rapidly move the arc terminals and thereby more rapidly elongate the arc.

It should be noted that electrodes 30A and 36H are not disposed on the surfaces 14A and 16H. The portions 32A and 32H are severed above the surface 14A and below the surface 16H and are securely electrically and mechanically connected to an upper, conductive spark gap plate 40 and a lower, conductive spark gap plate 42, respectively. The plates 12A and 40 and 12H and 42 may be preformed as physically identical assemblies for subsequent inclusion in the stack 13 at its opposite longitudinal ends in a reversed relationship (FIG. 2).

In accordance with a further important feature of the present invention, each of the gap plates 12 includes a pair of elongated, axially extending apertures 44 for receiving a pair of elongated indexing pins 46 that extend through all of the gap plates 12 to both vertically align and horizontally orient the gap plates 12 within the stack 13 and to thereby define and maintain the spacing between each pair of electrodes 30 and 36 in each of the chambers 20. The pins 46 are formed from a suitable dielectric material, such as polytetrafluoroethylene, and have an outer diameter of a magnitude to provide a close interference fit with the inner surfaces of the apertures 44 to thereby prevent substantial shifting of individual plates 12 within the stack 13.

Figure 1:
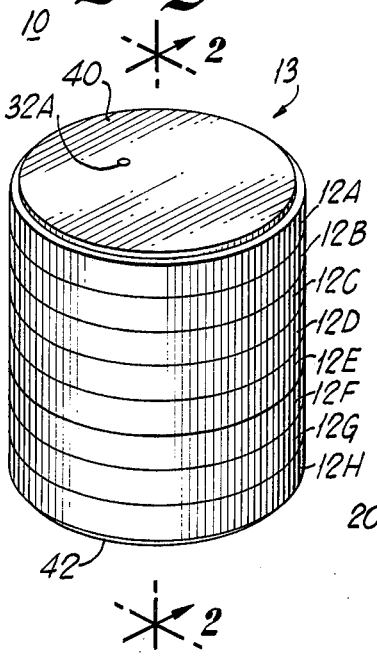
FIG. 1 is a perspective view of a spark gap constructed in accordance with the principles of the present invention.
Figure 3:
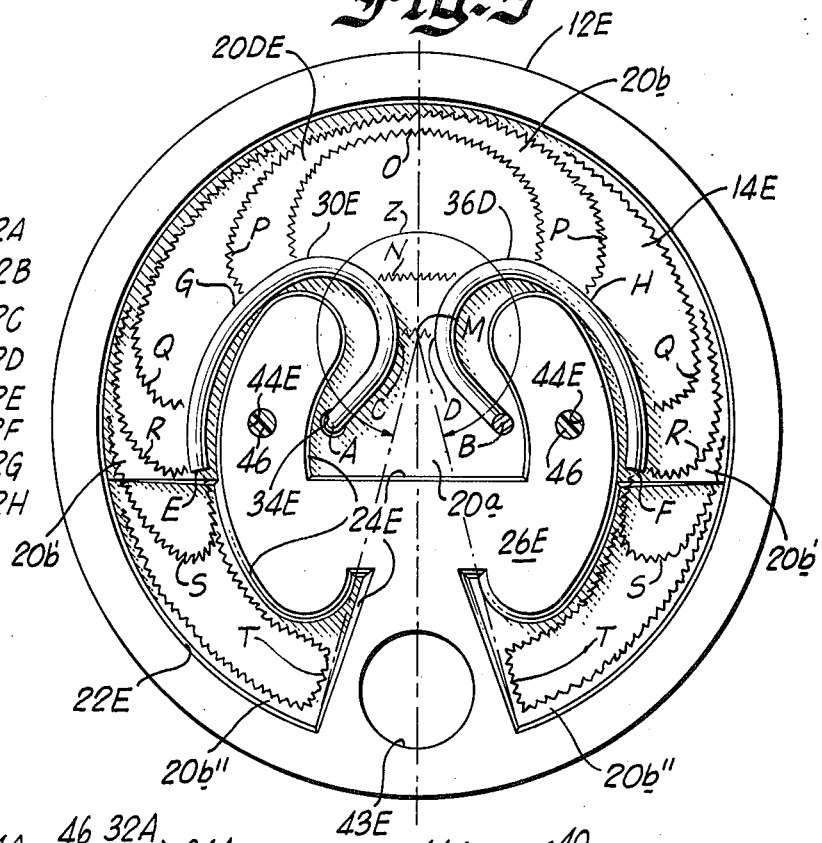
FIG. 3 is an enlarged, cross-sectional view of the spark gap of FIG. 1 taken along line 3—3 of FIG. 2.

In accordance with an important feature of the present invention, the disposition of the electrodes 30 and 36 in the arc chamber 20 effect the rapid elongation and compression of a follow current arc. As illustrated in FIG. 3, the electrodes 30E and 36D converge from divergent entrance portions A and B, respectively, to points C, D of minimum spacing, that is, the location of initial arcing and thereafter diverge to their longitudinal extremities at points E and F, respectively. Upon initiation of an electrical arc "M" at points C, D, the electrical current path for the flow of electrical current in the arc chamber 20DE is along the successive points A, C, D and B, forming a current loop about the innermost section **20*a* of the arc chamber 20DE. The use of wire electrodes 30E and 36D result in a region of high magnetic flux density at arc terminals C, D to thereby provide a magnetic motive force in the direction of a region of lower magnetic flux density, that is, the arc elongation and cooling section 20*b*, for rapidly moving the arc "M" into the section 20*b***.

Exemplary successive locations of the arc "M" in the arc elongation and cooling section **20*b* of the chamber 20DE** are illustrated at N, O, P, Q, R, S and T, although the arc may be interrupted prior to full elongation.

As the arc is elongated, the resultant magnetic force compresses the arc against the walls 22D and 22E and elongated sections of the walls 24D and 24E (FIG. 3) through an angle "Z" greater than 200°, and in a specific embodiment, approximately 330°. The angle "Z" is referred to hereinafter as the projected angle of arc elongation. In alternate embodiments, the projected angle may approach 360°. The large arc elongation and compression in the arc chambers 20 result in higher arc voltages than possible with prior art configurations.

As illustrated in FIG. 3, the follow current flow is along a path that includes an electrode portion and an arcing portion. In accordance with an important feature of the present invention, the electrodes 30E and 36D are configured and disposed as closely as possible to the walls 22D and 22E to achieve maximum arc compression throughout the projected angle of arc elongation without the developed arc voltage causing restrikes to the electrodes 30E and 36D and a resultant reduction in the length of the follow current path.

In a specific embodiment where the spark gap 10 (FIGS. 1-5) is used in a 9/10KV surge arrester, the spacing of the electrode 30E between point E and the spacing of the electrode 36E between point F, and the walls 22D and 22E is approximately 0.37 inches. The spacing between points G and H and the walls is approximately 0.45 inches. In the same specific embodiment, the outer diameter of the gap plate 12E is approximately 3.25 inches and the total depth of the arc chamber 20DE in the section 20*b'* between the facing plates 12D and 12E is approximately 0.12 inches. In addition, the distance between points C, D is approximately 0.08 inches; and the diameter of the wires used to form the electrodes 30E and 36D is 0.081 inches.

Obviously, many modifications and variations of the present invention are possible in light of the above teachings. For example, the gap plate 12 (FIG. 6) includes a boss 26 having a predetermined configuration such that a wire electrode 30 may be formed on the upper surface 14 (and a wire electrode 36 may be likewise formed on the lower surface 16) in a desired configuration merely by bending a unitary piece of wire extending through the aperture 34 about the boss 26 in a conforming contact with the interior walls 24 that define the boss 26. In embodiments where the aperture 43 is not required, the formed electrodes 30 and 36 (for example, 30E and 36E) need not overlie each other but may be disposed at various angles on the surfaces 14 and 16.

In a further alternate embodiment of the gap plate 12, a pair of gap plates 12L and 12M (FIG. 7) are formed with elongated, axially extending apertures 44L and 44M colinearly disposed along longitudinal axes with the elongated, longitudinally extending apertures 43L and 43M, as opposed to the noncolinear disposition of the apertures 44E (FIG. 3) with respect to the aperture 43E. In addition, the gap plates 12L and 12M (FIG. 7) include upraised, pedestal portions or bosses 48L and 48M that may be effective in interrupting direct communication of the hot gases formed by an electrical arc in the arc elongation and cooling portion 20*b* of the arc chamber 20LM to the location of initial arcing between the electrodes 30M and 36L, thereby reducing the tendency of an electrical arc to restrike. Thus, it is to be understood that, within the scope of the appended claims, the invention may be practiced otherwise than as specifically described. In one or more of the following claims, an important feature of the inventive spark gap is defined as including a plurality of insulating gap plates for defining an arc chamber and a plurality of electrodes disposed in the arc chamber wherein the arc chamber and the electrodes provide the sole means for the lengthening and compression of follow current arcs against peripheral walls of the arc chamber. The use of the term "providing the sole means for the lengthening and compression of follow current arcs" is intended to specifically exclude from the scope of the invention the use of supplementary magnetic means, such as, permanent magnets and electrical coils (for example, as illustrated in U.S. Pat. No. 3,504,221), to lengthen follow current arcs within an arc chamber and compress follow current arcs against the peripheral walls of the arc chambers.

What is claimed and desired to be secured by Letters Patent of the United States is:

1. A spark gap comprising
a first insulating gap plate,
a second insulating gap plate,
a third insulating gap plate,
means for retaining said first and third gap plates contiguously disposed about said second gap plate in a vertical stack along a first vertically extending longitudinal axis,
facing surfaces of said first and second gap plates forming a first arc elongation chamber,
facing surfaces of said second and third gap plates forming a second arc elongation chamber,
a first plurality of electrodes disposed with a first horizontal orientation in said first arc chamber to form a first electrode gap and
a second plurality of electrodes disposed with a second horizontal orientation in said second arc chamber to form a second electrode gap,
said first and second horizontal orientations being substantially identical such that said first and second electrode gaps are disposed in said vertical stack in vertical alignment along a second vertically extending axis disposed parallel to said first axis.

2. A spark gap as defined in claim 1 wherein said first and second pluralities of electrodes comprise first and second pluralities of wire electrodes.

3. A spark gap comprising
a plurality of generally horizontally disposed insulating gap plates, said gap plates including means for defining an arc chamber, and
means for forming a generally horizontally extending electrode gap in said arc chamber, said forming means comprising a plurality of electrodes disposed in a generally horizontal orientation in said arc chamber, said arc chamber and said electrodes providing the sole means for the lengthening and compression of follow current arcs against said defining means and providing a projected angle of maximum arc elongation of at least 200°.

4. A spark gap as defined in claim 2 wherein said projected angle of maximum arc elongation is in the range of 200° to an angle approaching 360°.

5. A spark gap comprising
a plurality of at least three insulating gap plates, each one of said gap plates having a plurality of at least two apertures extending entirely through said one gap plate and an upper surface and an oppositely disposed lower surface,
the lower surface of a first gap plate of said plurality of gap plates and the upper surface of an adjacent second gap plate of said plurality of gap plates defining a first arc elongation chamber, the lower surface of said second gap plate and the upper surface of an adjacent third gap plate of said plurality of gap plates defining a second arc elongation chamber,
said first arc chamber having a first pair of electrodes disposed therein, said first pair of electrodes forming a first electrode gap between said first pair of electrodes,
said second arc chamber having a second pair of electrodes disposed therein, said second pair of electrodes forming a second electrode gap between said second pair of electrodes, and
means for securely retaining said plurality of gap plates in a stacked condition, said retaining means comprising a plurality of elongated pins extending into each of said apertures in said first, second and third gap plates and extending entirely through the apertures in said second gap plate.

6. A spark gap as defined in claim 5 wherein said plurality of pins numercially equals two.

7. A spark gap comprising a plurality of at least three insulating gap plates, each one of said gap plates having a plurality of at least two apertures extending entirely through said one gap plate and a generally horizontally extending upper surface and an oppositely disposed, generally horizontally extending lower surface, the lower surface of a first gap plate of said plurality of gap plates and the upper surface of an adjacent second gap plate of said plurality of gap plates defining a first arc elongation chamber, the lower surface of said second gap plate and the upper surface of an adjacent third gap plate of said plurality of gap plates defining a second arc elongation chamber, said first arc elongation chamber having a first pair of electrodes disposed therein, said first pair of electrodes forming a first electrode gap between said first pair of electrodes, said second arc chamber having a second pair of electrodes disposed therein, said second pair of electrodes forming a second electrode gap between said second pair of electrodes, and means for defining and maintaining the gap spacings of said first electrode gap and said second electrode gap, said defining and maintaining means comprising a plurality of elongated pins extending into each of said apertures in said first, second and third gap plates and extending entirely through the apertures in said second gap plate.

8. A spark gap as defined in claim 7 wherein said pair of electrodes comprises a pair of wire electrodes.

9. A spark gap comprising an insulating gap plate having a generally horizontally extending upper surface and an oppositely disposed, generally horizontally extending lower surface and an aperture extending through said gap plate from said upper surface to said lower surface, a first wire electrode disposed on said upper surface, a second wire electrode disposed on said lower surface and conductive wire means disposed in said aperture for electrically interconnecting said first electrode and said second electrode, said first electrode and said second electrode and said conductive wire means being integrally formed portions of an unitary length of wire.

10. A spark gap as defined in claim 9 wherein said gap plate further comprises an integrally formed boss protruding above said upper surface and defined by a plurality of walls extending from said upper surface.

11. A spark gap as defined in claim 10 wherein said first wire electrode is disposed about said boss in a conforming contact with an elongated section of said wall.

* * * * *